US009664426B2

(12) United States Patent
Moore

(10) Patent No.: US 9,664,426 B2
(45) Date of Patent: May 30, 2017

(54) SYSTEM AND METHOD FOR IMPROVING EFFICIENCY OF A REFRIGERANT BASED SYSTEM

(71) Applicant: AGILE 8 CONSULTING LIMITED, Hong Kong (HK)

(72) Inventor: Kevin Daniel Martin Moore, Hong Kong (HK)

(73) Assignee: Agile8 Consulting Limited, Hong Kong (CN)

( * ) Notice: Subject to any disclaimer, the term of this patent is extended or adjusted under 35 U.S.C. 154(b) by 341 days.

(21) Appl. No.: 14/356,883

(22) PCT Filed: Jul. 29, 2013

(86) PCT No.: PCT/IB2013/056197

§ 371 (c)(1),
(2) Date: May 7, 2014

(87) PCT Pub. No.: WO2014/030083

PCT Pub. Date: Feb. 27, 2014

(65) Prior Publication Data

US 2015/0168043 A1 Jun. 18, 2015

Related U.S. Application Data

(60) Provisional application No. 61/691,259, filed on Aug. 20, 2012.

(51) Int. Cl.
*F25B 49/02* (2006.01)
*F25B 25/00* (2006.01)

(52) U.S. Cl.
CPC ..... *F25B 49/022* (2013.01); *F25B 25/005* (2013.01); *F25B 2600/01* (2013.01);
(Continued)

(58) Field of Classification Search
CPC .. F25B 49/022; F25B 25/005; F25B 2600/01; F25B 2600/02; F25B 2700/2117; F25B 2700/21171; F25B 2600/0251
(Continued)

(56) References Cited

U.S. PATENT DOCUMENTS 5,826,439 A * 10/1998 Baruschke ..... B60H 1/321 62/208
5,934,087 A * 8/1999 Watanabe ..... F25B 49/005 62/126
(Continued)

FOREIGN PATENT DOCUMENTS

EP 1912029 A1 4/2008
HK 1137899 A 8/2010
(Continued)

*Primary Examiner* — Mohammad M Ali
(74) *Attorney, Agent, or Firm* — Eagle IP Limited; Jacqueline C. Lui

(57) ABSTRACT

The present invention is designed to reduce running costs in refrigerant based air-conditioning, refrigeration and heating systems by using a combination of thermodynamic and hydraulic control to manage the on and off states of the compressor, which is the main energy consuming component. Thermodynamic or temperature control is used to manage comfort levels within the room or space being cooled. Hydraulic control is used to determine when the compressor has completed its useful work in delivering a supply of high-pressure liquid refrigerant. Once temperature and hydraulic conditions are satisfied the compressor can be turned off; thereby delivering a significant reduction in running costs.

18 Claims, 4 Drawing Sheets

(52) U.S. Cl.
CPC ... *F25B 2600/02* (2013.01); *F25B 2600/0251* (2013.01); *F25B 2700/2103* (2013.01); *F25B 2700/2104* (2013.01); *F25B 2700/2117* (2013.01); *F25B 2700/21171* (2013.01)

(58) Field of Classification Search
USPC ..... 62/115, 228.1
See application file for complete search history.

(56) References Cited

U.S. PATENT DOCUMENTS 6,330,909 B1 * 12/2001 Takahashi ..... B60H 1/005 165/202
7,812,733 B2 * 10/2010 Perten ..... H04Q 9/00 340/585
2001/0017037 A1 * 8/2001 Martin ..... F25B 49/02 62/216
2004/0134207 A1 * 7/2004 Morita ..... B60H 1/00792 62/158
2004/0154324 A1 * 8/2004 Hashimoto ..... B60H 1/00792 62/228.1
2006/0059930 A1 * 3/2006 Eisenhour ..... B60H 1/3216 62/228.5
2007/0256436 A1 * 11/2007 Hayashi ..... B60H 1/00735 62/161
2007/0262161 A1 11/2007 Davies
2009/0000319 A1 * 1/2009 Kurata ..... B60H 1/3205 62/133
2009/0049849 A1 * 2/2009 Kim ..... F25B 49/022 62/156
2010/0291853 A1 * 11/2010 Koshobu ..... B60H 1/00428 454/155
2011/0271273 A1 * 11/2011 Dumais ..... H04L 67/42 717/175
2012/0117995 A1 5/2012 Moore

FOREIGN PATENT DOCUMENTS

JP H06101910 A 4/1994
JP 2007302020 A 11/2007

* cited by examiner

SYSTEM AND METHOD FOR IMPROVING EFFICIENCY OF A REFRIGERANT BASED SYSTEM

CROSS REFERENCE TO RELATED APPLICATIONS

This application claims the priority to international application no. PCT/IB2013/056197 filed on Jul. 29, 2013, which claims the benefit of U.S. Provisional Application No. 61/691,259 filed Aug. 20, 2012. The entire disclosures of the aforesaid application No. 61/691,259 and PCT/IB2013/056197 are hereby incorporated by reference herein.

FIELD OF INVENTION

This invention relates to a refrigerant based system for controlling temperature of a medium in an enclosed space and a method for improving the efficiency of the refrigerant based system; in particular, this invention relates to refrigerant based air-conditioning, refrigeration and heating systems.

BACKGROUND OF INVENTION

A typical refrigerant based air-conditioning, refrigeration and heating system comprises a compressor and an associated condenser (or heat exchanger), which are used to convert low-pressure refrigerant vapor into high-pressure liquid refrigerant for cooling purposes. In this compression of vapor, a very large amount of heat is generated and this heat can be either dissipated externally to the space that will be cooled or used for heating in a reverse cycle system (also called a heat pump system). The high-pressure liquid refrigerant is then transported to an evaporator (or heat exchanger) and is allowed to decompress there back to a vapor. In this decompression phase change process, the evaporator/second heat exchanger temperature reduces significantly and the reduction in temperature is limited by a significant amount of heat which is absorbed from the air passing through the evaporator/second heat exchanger. The heat removed from the air passing through the evaporator/second heat exchanger produces a supply of very cold air into the room or area being cooled. A blower fan is used to drive air though the evaporator. The supply of low-pressure refrigerant is then returned to the compressor.

Air-conditioning, refrigeration and heating systems employing refrigerants can account for up to 60% of the energy demand in office and domestic/residential installations. However, despite recent technology improvements, refrigerant based systems have yet to benefit from a significant reduction in running costs and as a result this sector remains inefficient compared with other energy consuming areas. As an example, lighting typically accounts for only 10-20% of the total energy demand but recent energy reduction advances have reduced running costs by 80% or more compared with earlier designs.

SUMMARY OF INVENTION

In the light of the foregoing background, it is an object of the present invention to provide an improved system and/or method to reduce the running costs and enhance the efficiency of a refrigerant based system in controlling the temperature of a medium in an enclosed space.

Accordingly, the present invention, in one aspect, is a refrigerant based system for regulating temperature of a medium in an enclosed space comprising a heat exchanger, a heat exchanger temperature sensor adapted for measuring the temperature of the heat exchanger, at least one compressor, a microprocessor for controlling the compressor, a medium temperature sensor adapted for measuring the temperature of the medium of the enclosed space, and a computer-readable storage medium encoded with computer-readable instruction for causing the microprocessor to execute the following steps:

(i) a medium temperature determining step for checking if the temperature of the medium has reached a first predetermined value;

(ii) a time determining step for checking if the compressor has operated for a predetermined period of operation time;

(iii) a minimum heat exchanger temperature determining step for checking if the temperature of heat exchanger has reached a minimum heat exchanger temperature;

(iv) a heat exchanger temperature determining step for checking if the temperature of the heat exchanger has reached a value below a compressor control temperature; and (v) a controlling step for controlling the compressor.

The compressor will be turned off in the controlling step if the following conditions are satisfied: (1) the temperature of the medium has reached the first predetermined value; (2) the temperature of the heat exchanger has reached a value below the compressor control temperature; (3) the compressor has operated for the predetermined period of operation time and; (4) the minimum heat exchanger temperature has been found.

In one exemplary embodiment, the predetermined period of operation time in the time determining step is at least 3 minutes; the first predetermined value is one degree Celsius below a setpoint temperature set by a user; and the compressor control temperature is two degrees Celsius below the setpoint temperature set by the user.

Another aspect of the present invention is a computer-readable storage medium, for use in a refrigerant based system for regulating the temperature of a medium of an enclosed space, encoded with computer-readable instruction for causing a microprocessor to execute the following steps:

(i) a medium temperature determining step for checking if the temperature of the medium has reached a first predetermined value;

(ii) a time determining step for checking if a compressor has operated for a predetermined period of operation time;

(iii) a minimum heat exchanger temperature determining step for checking if the temperature of a heat exchanger has reached a minimum heat exchanger temperature;

(iv) a heat exchanger temperature determining step for checking if the temperature of the heat exchanger has reached a value below a compressor control temperature; and (v) a controlling step for controlling the compressor.

The compressor will be turned off in the controlling step if the following conditions are satisfied: (1) the temperature of the medium has reached the first predetermined value; (2) the temperature of the heat exchanger has reached a value below the compressor control temperature; (3) the compressor has operated for the predetermined period of operation time and; (4) the minimum heat exchanger temperature has been found.

In one exemplary embodiment, the predetermined period of operation time in the time determining step is at least 3 minutes; the first predetermined value is one degree Celsius below a setpoint temperature set by a user; and the compressor control temperature is two degrees Celsius below the setpoint temperature set by the user.

In yet another aspect of the present invention is an energy managing device for use in a system regulating the temperature of a medium of an enclosed space comprising a microprocessor for controlling a compressor and a computer-readable storage medium as mentioned above.

In another aspect of the present invention, a method for regulating the temperature of a medium of an enclosed space in a refrigerant based system comprising the following steps:

(a) providing within the system at least one compressor, a heat exchanger, a heat exchanger temperature sensor adapted for measuring the temperature of the heat exchanger, and a medium temperature sensor adapted for measuring the temperature of the medium of the enclosed space;

(b) a medium temperature determining step for checking if the temperature of the medium has reached a first predetermined value;

(c) a time determining step for checking if the compressor has operated for a predetermined period of operation time;

(d) a minimum heat exchanger temperature determining step for checking if the temperature of heat exchanger has reached a minimum heat exchanger temperature;

(e) a heat exchanger temperature checking step for checking if the temperature of the heat exchanger has reached a value below a compressor control temperature; and (f) a controlling step for controlling said compressor.

The compressor will be turned off in the controlling step if the following conditions are satisfied: (1) the temperature of the medium has reached the first predetermined value; (2) the temperature of the heat exchanger has reached a value below the compressor control temperature; (3) the compressor has operated for the predetermined period of operation time and; (4) the minimum heat exchanger temperature has been found.

In one specific implementation, the predetermined period of operation time in the time determining step is at least 3 minutes; the first predetermined value is one degree Celsius below a setpoint temperature set by a user; and the compressor control temperature is two degrees Celsius below the setpoint temperature set by the user.

In another aspect of the present invention, there is provided a chiller comprising a heat exchanger, at least one compressor, a heat exchanger temperature sensor for measuring the temperature of the heat exchanger, a microprocessor for controlling the compressor, a computer-readable storage medium encoded with computer-readable instructions for causing the microprocessor to execute the following steps:

(i) a delaying step of waiting for three minutes on first powering up the chiller before switching on the compressor;

(ii) a monitoring step of measuring the temperature of the heat exchanger in order to find a minimum heat exchanger temperature;

(iii) a controlling step of turning off the compressor if the minimum heat exchanger temperature has been detected in the monitoring step;

(iv) a restarting step of measuring the temperature of the heat exchanger and restarting the compressor if the heat exchanger temperature has reached a predetermined value.

There are many advantages to the present invention. One of the advantages is that the running costs can be reduced and the efficiency in controlling the temperature of a medium of an enclosed space can be enhanced upon implementation of the present invention into a conventional refrigerant based air-conditioning, refrigeration and heating system. Also the present invention can help in protecting the environment by reducing the production of greenhouse gas with the use of less energy/electricity. Furthermore, the present invention can also reduce the heat emitted by a conventional air-conditioner to the ambient environment, thereby cooling off the ambient environment, particularly that in a crowded city.

DETAILED DESCRIPTION OF THE PREFERRED EMBODIMENTS

As used herein and in the claims, "comprising" means including the following elements but not excluding others.

Figure 1:
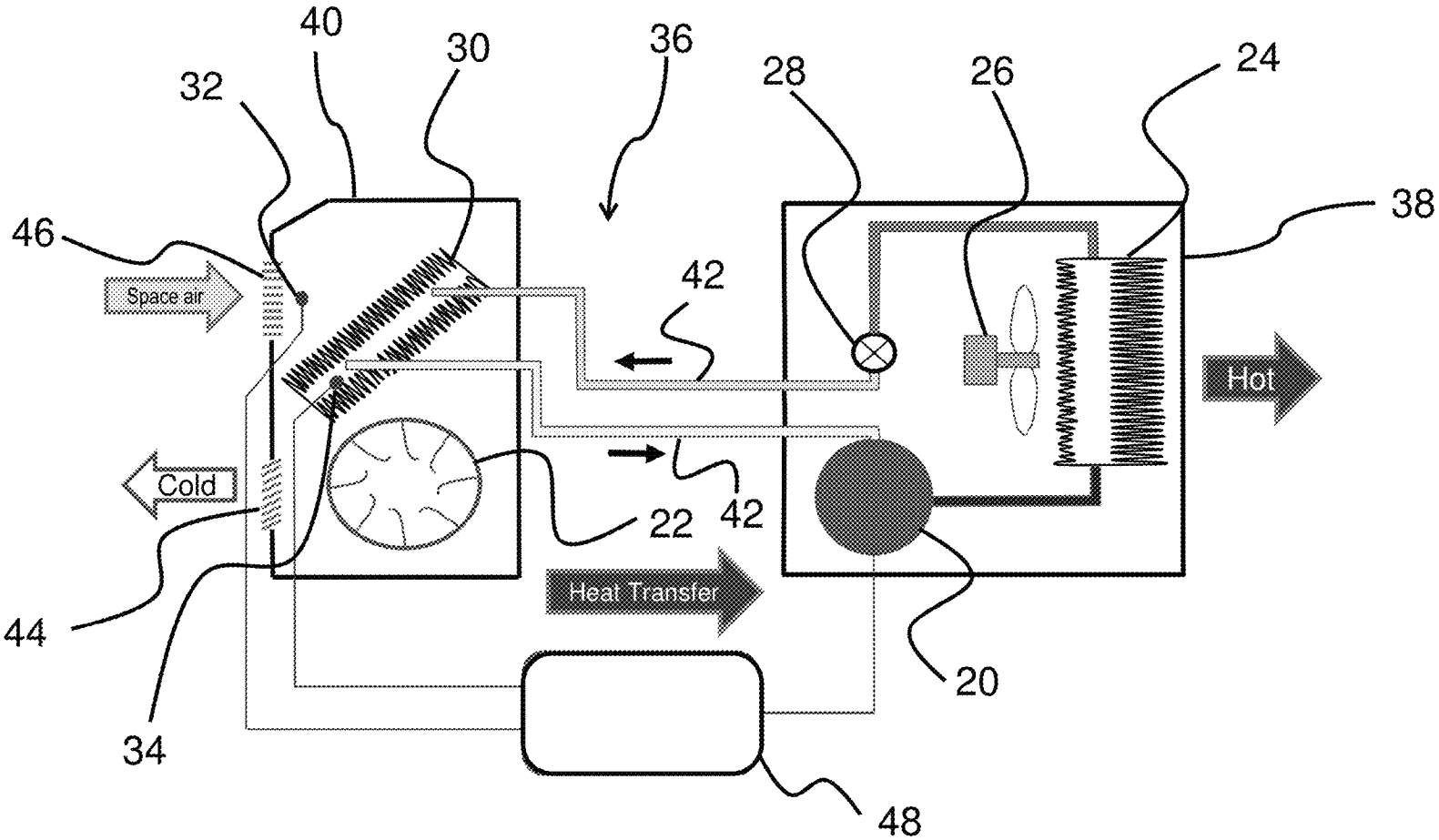
FIG. 1 is a schematic view of a refrigerant based system for controlling temperature of a medium in an enclosed space in accordance with the first embodiment of the present invention.
Figure 2:
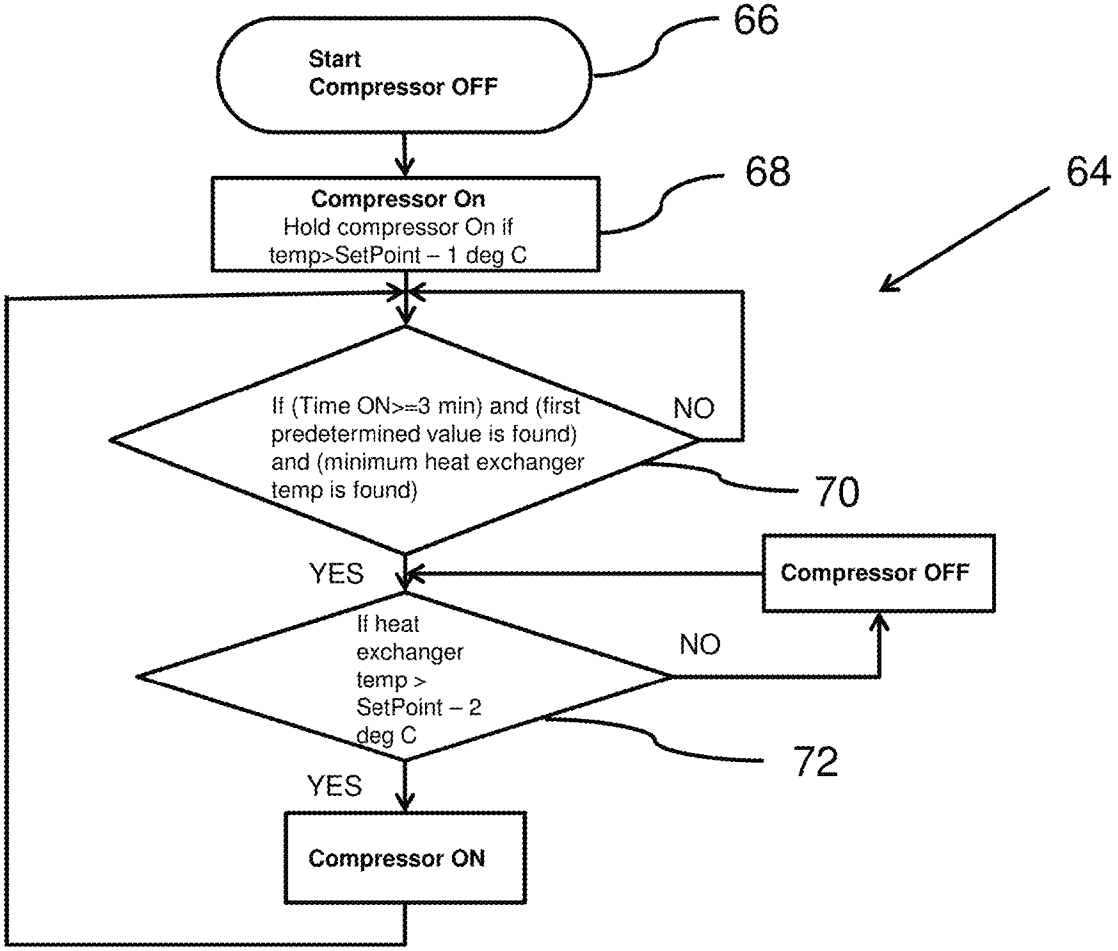
FIG. 2 is a flow chart illustrating steps in a method for regulating the temperature of a medium in an enclosed space in a refrigerant based system of the same embodiment of the present invention.
Figure 3:
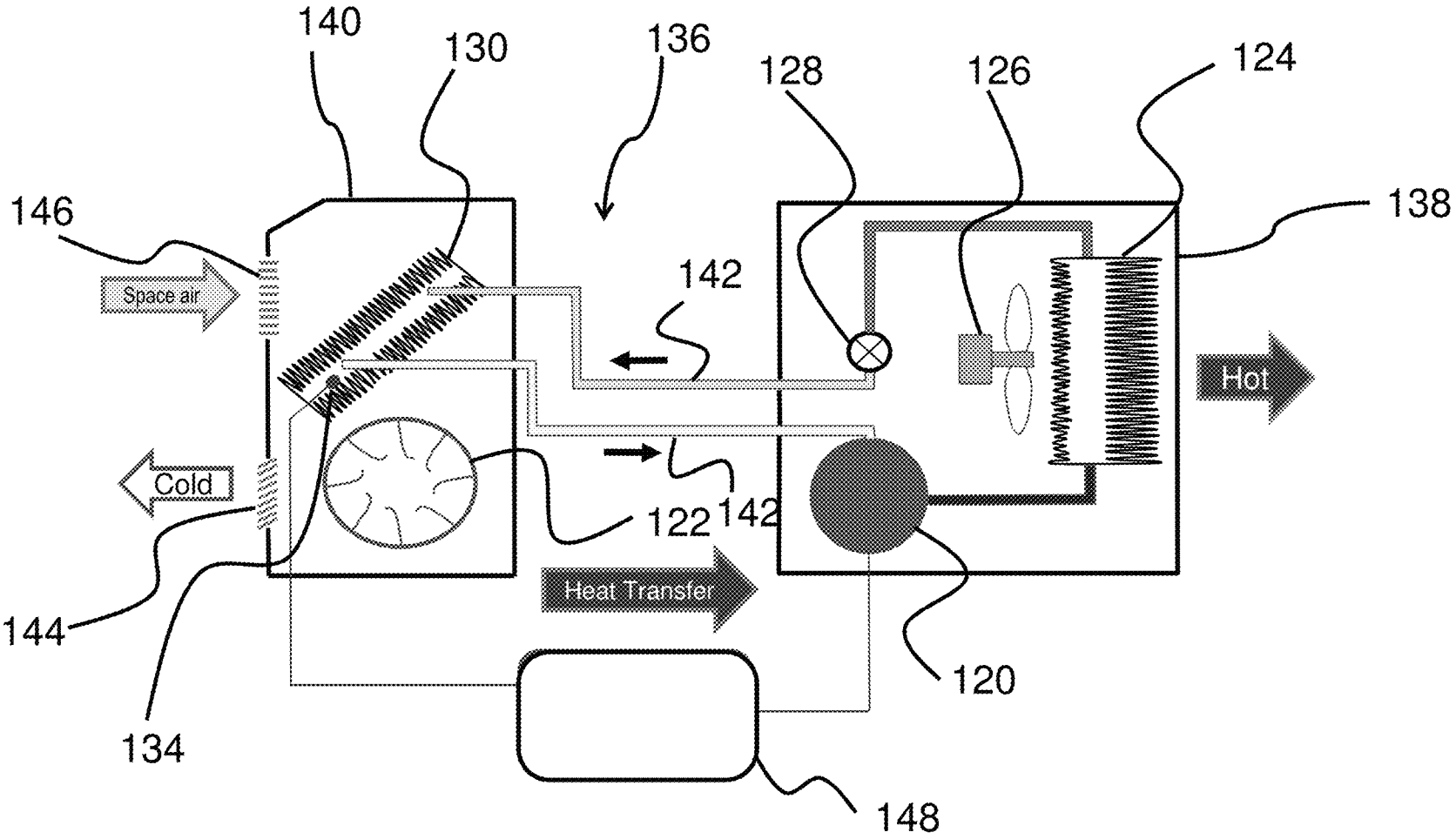
FIG. 3 is a schematic view of a chiller in accordance with another embodiment of the present invention.
Figure 4:
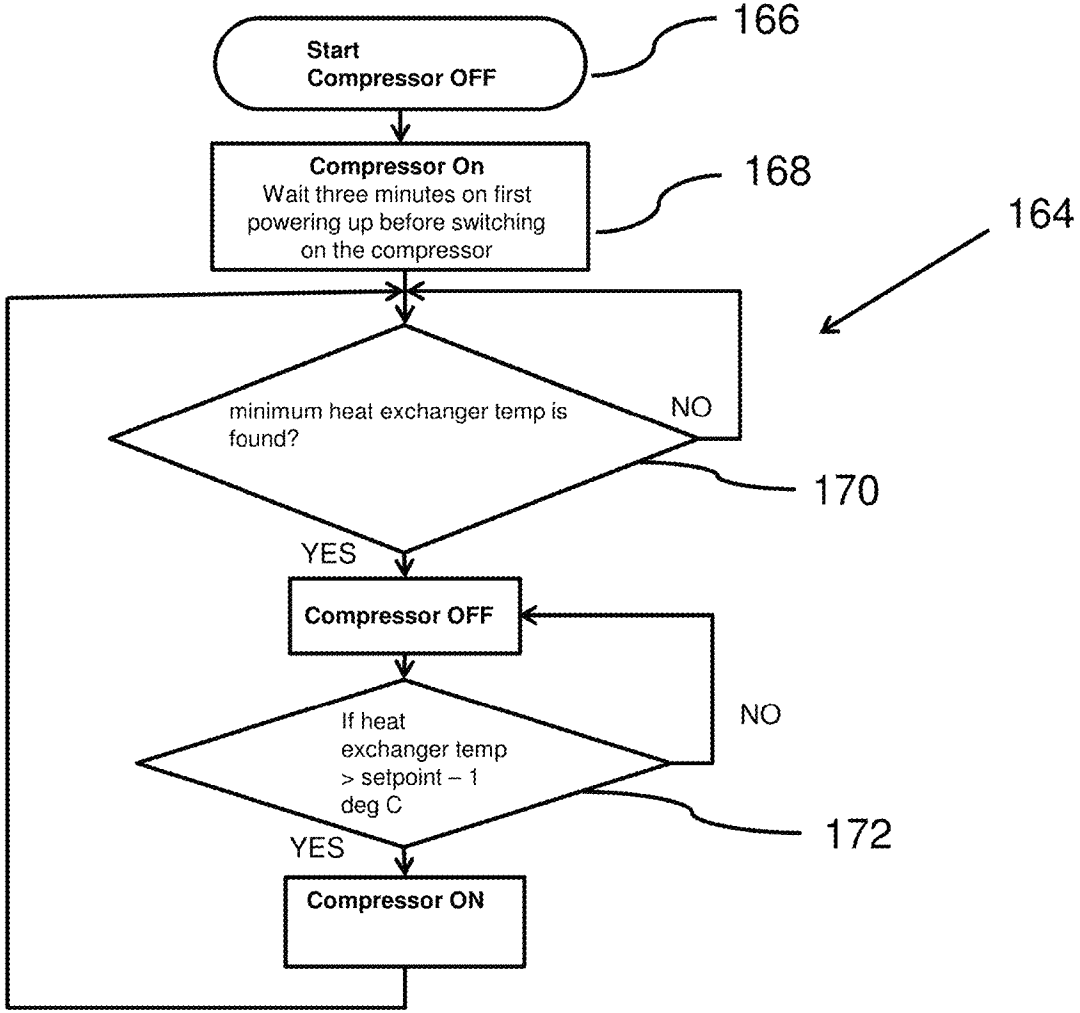
FIG. 4 is a flow chart illustrating steps in a method for regulating the temperature of a medium in a chiller of the same embodiment of the present invention.

Two embodiments of the invention are disclosed, mainly the first embodiment indicated by the numeral 36 shown in FIG. 1 and the numeral 64 shown in FIG. 2, and the second embodiment designated by numeral 136 shown in FIG. 3 and the numeral 164 shown in FIG. 4.

First Embodiment

Referring first to FIG. 1, the first embodiment of the present invention is a refrigerant based system 36 for controlling temperature of a medium (i.e. gas or liquid) in an enclosed space. The refrigerant based system 36 comprises an interior unit 40 and an exterior unit 38. The interior unit 40 and the exterior unit 38 are connected by a pair of circulation pipes 42. The interior unit 40 further comprises a heat exchanger 30, a heat exchanger temperature sensor 34, a medium temperature sensor 32, an evaporator blower 22, a cold medium outlet 44 and a space medium inlet 46. The heat exchanger temperature sensor 34 is located in proximity to the heat exchanger 30 and configured to measure the temperature of the heat exchanger 30. The medium temperature sensor 32 is located in proximity to the space medium inlet 46 and configured to measure the temperature of the medium in the enclosed space. The evaporator blower 22 drives the space medium from the enclosed space to the interior unit 40 through the space medium inlet 46 and the heat exchanger 30, and then blows the cooled space medium through the cold medium outlet 44 back to the enclosed space.

The exterior unit 38 comprises an exterior blower 26, an expansion valve 28, a condenser 24, and a compressor 20. The pair of circulation pipes 42 is configured to transfer refrigerant between the condenser 24 in the exterior unit 38 and the heat exchanger 30 in the interior unit 40. The exterior blower 26 is located in proximity to the condenser 24 and configured to remove the heat generated at the condenser 24. The compressor 20 is located upstream of the condenser 24, but downstream of the heat exchanger 30.

Conversely, the expansion valve 28 is located downstream of the condenser 24, but upstream of the heat exchanger 30. In a specific embodiment, the compressor 20 used in the present invention is an ON/OFF compressor 20 in which the compressor 20 can only operate at a full-speed mode or a complete-stop mode. A control 48, connecting the compressor 20, the medium temperature sensor 32 and the heat exchanger temperature sensor 34, is configured to control the compressor 20 based on the inputs from the medium temperature sensor 32 and the heat exchanger temperature sensor 34. The control 48 comprises a microprocessor 52 and a computer-readable storage medium 50 encoded with computer-readable instruction for causing the microprocessor 52 to execute the following steps:

(1) A medium temperature determining step for checking if the temperature of the medium has reached a first predetermined value. In one embodiment, the temperature of the medium is measured by the medium temperature sensor 32 and the detected medium temperature is sent to the microprocessor 52 for evaluating whether the first predetermined value has been reached. In another embodiment, the first predetermined value is at least one degree Celsius below a setpoint temperature; in one embodiment, the setpoint temperature is set by a user.

(2) A time determining step for checking if the compressor 20 has operated for a predetermined period of operation time. In one embodiment, the predetermined period of operation time in the time determining step is at least 3 mins.

(3) A minimum heat exchanger temperature determining step for checking if the heat exchanger 30 has reached a minimum heat exchanger temperature. In one embodiment, the temperature of the heat exchanger 30 is measured by the heat exchanger sensor 34 and the detected heat exchanger temperature is sent to the microprocessor 52 for determination of the minimum heat exchanger temperature. In another embodiment, the minimum heat exchanger temperature is determined by continuously comparing a newly measured heat exchanger temperature with a previously measured heat exchanger temperature. If the newly measured heat exchanger temperature is higher or equal to the previously measured heat exchanger temperature, the minimum heat exchanger temperature is reached.

(4) A heat exchanger temperature determining step for checking if the temperature of the heat exchanger 30 has reached a value below a compressor control temperature. In one embodiment, the temperature of the heat exchanger 30 is measured by the heat exchange sensor 34 and the detected heat exchanger temperature is sent to the microprocessor 52 for evaluating whether the compressor control temperature has been reached. In another embodiment, the compressor control temperature is two degrees Celsius below a setpoint temperature; in one specific embodiment, the setpoint temperature is set by a user; in one specific embodiment, the setpoint temperature is set by a user.

(5) A controlling step for controlling the compressor 20. In one embodiment, the compressor 20 will be turned off in the controlling step if the following conditions have been satisfied: (1) the temperatures of the medium has reached the first predetermined value; (2) the temperature of the heat exchanger has reached a value below the compressor control temperature; (3) the compressor has operated for the predetermined period of operation time and; (4) the minimum heat exchanger temperature has been found.

In one embodiment, the steps listed above are executed in the aforesaid sequence.

In another embodiment, the computer-readable instruction 50 causes the microprocessor to further execute the following steps:

(i) An adjusting step for deciding a stable setpoint temperature if a setpoint temperature set by the user is lower than a second predetermined value. In one specific embodiment, the stable set point temperature is 23° C. whereas the second predetermined value is 18° C.;

(ii) A notifying step for issuing a notification for requiring service if the stable setpoint temperature in the adjusting step is above a third predetermined value. In one specific embodiment, the third predetermined value is 23° C.;

(iii) An alerting step of issuing a servicing alert if the minimum heat exchanger temperature is above a fourth predetermined value. In one specific embodiment, the fourth predetermined value is 10° C.; and (iv) A restarting step of restarting the compressor 20 if the temperature of the heat exchanger 30 has reached a value above the compressor control temperature. In one specific embodiment, the compressor control temperature is two degrees Celsius below a setpoint temperature set by a user.

In one embodiment, the restarting step is performed after execution of the controlling step. In another embodiment, the temperatures in the above steps (i.e. the temperature of the medium, the temperature of the heat exchanger 30) are measured once every predetermined interval. In one embodiment, the predetermined interval is 5 seconds. In another embodiment, the temperatures are measured at least every 5 seconds.

In yet another embodiment, the control 48 acts as an energy managing device for use in the refrigerant based system 36 comprising the aforementioned components mentioned and performing the aforementioned steps.

Now turning to the operation of the refrigerant based system 36 described above. The instant embodiment of invention makes use of two temperature sensors (32 and 34) to deliver significantly reduced running costs in which the heat exchanger temperature sensor 34 is used for hydraulic control in detecting when the compressor 20 has filled available space with high pressure liquid refrigerant and hence has completed its useful work. FIG. 2 shows a flowchart describing how the control 48 works according to one embodiment of the present invention.

Referring to FIG. 2, at step 66, the refrigerant based system 36 is switched on with the compressor 20 being turned off before the start of the control process. Next, at step 68, the compressor 20 is turned on and starts running with the medium temperature being measured at a predetermined frequency. In one embodiment, the medium temperature measurement is made at least every five seconds. The control 48 will first seek to establish the first predetermined value around a setpoint temperature desirable by a user. In one embodiment, the first predetermined value is 1 degree Celsius below the setpoint temperature to minimize any subsequent temperature variations once the compressor 20 is switched OFF later on. If the setpoint temperature has been set lower than a second predetermined value, then the control 48 will determine a stable setpoint temperature for use in on-going control. In one embodiment, the stable setpoint temperature is 23° C. whereas the second predetermined value is 18° C. If this stable setpoint temperature is above a third predetermined value, then the control 48 will issue a notification that the refrigerant based system 36 requires servicing. In one embodiment, the third predetermined value is 23° C.

Having satisfied the medium temperature requirements described above, at step 70, the control 48 will next verify whether the compressor 20 has completed its useful work in filling the available space with high pressure liquid refrigerant. This hydraulic control assessment is carried out by seeking a minimum heat exchanger temperature as extensive modeling has indicated that this is a good measure to use with regard to hydraulic performance. Once the control 48 has verified that (1) the compressor 20 has been running for a predetermined period of time, (2) that the medium temperature has reached the first predetermined value and (3) that the minimum heat exchanger temperature has indeed been reached, then the control 48 will proceed to step 72. In one embodiment, the predetermined period of time in step 70 is at least 3 minutes. Ensuring the compressor 20 has been running for a minimum of 3 minutes by the control 48 can prevent short cycling of the compressor 20. In another embodiment, the first predetermined value in step 70 is 1 degree Celsius below the setpoint temperature. In yet another embodiment, in order to determine whether the minimum heat exchanger temperature has indeed been reached, the control 48 continuously compares a newly measured heat exchanger temperature and a previously measured heat exchanger temperature. If the newly measured heat exchanger temperature is higher or equal to the previously measured heat exchanger temperature, the minimum heat exchanger temperature has then been reached. In another embodiment, the present invention takes one temperature measurement every five seconds on the medium temperature and the heat exchanger temperature.

At step 72, the control 48 will de-energize a relay to stop the compressor 20 if the heat exchanger temperature has reached a value below a compressor control temperature. In one embodiment, the compressor control temperature in step 72 is 2 degrees Celsius below the setpoint temperature. If the control 48 detects that the minimum heat exchanger temperature is above a fourth predetermined value, then a notification will be issued indicating that the refrigerant based system 36 requires servicing. On stopping the compressor 20, the evaporator blower 22 will continue to run and the heat exchanger temperature will remain at the minimum heat exchanger temperature for a short time, unit all high pressure refrigerant liquid has been used up. In one embodiment, the fourth predetermined value is 10° C. When all of the high pressure liquid refrigerant has been exhausted the heat exchanger temperature will rise, initially quickly and then at a reducing rate proportional to the difference between the medium temperature and the heat exchanger temperature. While the heat exchanger temperature is increasing the medium is still being cooled; albeit at a reducing rate. Once the heat exchanger temperature has reached the compressor control temperature, the control 48 will restart the compressor 20 and the control cycle will repeat itself. In one embodiment, the compressor control temperature is two degrees below the setpoint temperature. In another embodiment, the present invention takes one temperature measurement every five seconds on the medium temperature and the heat exchanger temperature.

The present invention is designed to reduce running costs in refrigerant based air-conditioning, refrigeration and heating systems by using a combination of thermodynamic and hydraulic control to manage the on and off states of the compressor 20 which is the main energy consuming component. Thermodynamic or temperature control is used to manage comfort levels within medium being cooled. Hydraulic control is used to determine when the compressor 20 has completed its useful work in delivering a supply of high-pressure liquid refrigerant. As discussed above, once temperature and hydraulic conditions are satisfied the compressor 20 can be turned off; thereby delivering a significant reduction in running costs.

The refrigerant based system 36 can be a commercial and residential air conditioning system employing one or more compressors and refrigerants where air is the delivered cooled medium; or a commercial and residential air conditioning unit with reverse cycle (heat pump) heating functions employing one or more compressors and refrigerants where air is the delivered cooled medium; or a commercial refrigeration unit employing one or more compressors and refrigerants where air is the delivered cooled medium; or a centralized chiller unit employing one or more compressors and refrigerants where water is the delivered cooled medium.

Second Embodiment

Now referring to FIG. 3, the second embodiment of the present invention is specifically designed and used for chillers. The chiller as illustrated in the embodiment shown in FIG. 3 comprises an interior unit 140 and an exterior unit 138. The interior unit 140 and the exterior unit 138 are connected by a pair of circulation pipes 142. The interior unit 140 further comprises a heat exchanger 130, a heat exchanger temperature sensor 134, an evaporator blower 122, a cold medium outlet 144 and a space medium inlet 146. The heat exchanger temperature sensor 134 is located in proximity to the heat exchanger 130 and configured to measure the temperature of the heat exchanger 130. The evaporator blower 122 drives the space medium from the enclosed space to the interior unit 40 through the space medium inlet 146 and the heat exchanger 130, and then blows the cooled space medium through the cold medium outlet 144 back to the enclosed space.

The exterior unit 138 comprises an exterior blower 126, an expansion valve 128, a condenser 124, and a compressor 120. The pair of circulation pipes 142 is configured to transfer refrigerant between the condenser 124 in the exterior unit 138 and the heat exchanger 130 in the interior unit 140. The exterior blower 126 is located in proximity to the condenser 124 and configured to remove the heat at the condenser 124. The compressor 120 is located upstream of the condenser 124, but downstream of the heat exchanger 130. Conversely, and the expansion valve 128 is located downstream of the condenser 124, but upstream of the heat exchanger 130. In a specific embodiment, the compressor 120 used in the present invention is an ON/OFF compressor in which the compressor 120 can only operate at a full-speed mode or complete-stop mode. A control 148, connecting to the compressor 120 and the heat exchanger temperature sensor 134, is configured to control the compressor 120 based on the input from the heat exchanger temperature sensor 134. The control 148 comprises a microprocessor 152 and a computer-readable storage medium 150 encoded with computer-readable instructions for causing said microprocessor 152 to execute the following steps:

(1) A delaying step of waiting for a first delaying time period on first powering up the chiller before switching on the compressor 120. In one embodiment, the first delaying time period is at least three minutes;

(2) A monitoring step of measuring the temperature of the heat exchanger 130 in order to find a minimum heat exchanger temperature. In another embodiment, the minimum heat exchanger temperature is determined by continuously comparing a newly measured heat exchanger temperature and a previously measured heat exchanger temperature.

If the newly measured heat exchanger temperature is higher or equal to the previously measured heat exchanger temperature, the minimum heat exchanger temperature has been reached;

(3) A controlling step of turning off the compressor 120 if the minimum heat exchanger temperature has been detected in the monitoring step;

(4) a restarting step of measuring the temperature of the heat exchanger 130 and restarting the compressor 120 if the heat exchanger temperature has reached a compressor control temperature. In one embodiment, the compressor control temperature in the restarting step is one degree Celsius below a setpoint temperature set by a user.

In another embodiment, the steps listed above are executed in the aforesaid sequence.

Now turning to the operation of the chiller as mentioned in the second embodiment as shown in FIG. 4. In the first step 166, in which the chiller 136 was switched on. Next, at step 168, the control 148 will wait for a first delay time period on first powering up the chiller 136 before switching on the compressor 120. In one implementation, the first delay time period is at least three minutes.

At step 170, the heat exchanger temperature sensor 134 will then monitor the heat exchanger temperature once every predetermined time period until it detects a minimum heat exchanger temperature. In one implementation, the predetermined time is at least 5 seconds; in another implementation, the minimum heat exchanger temperature is −8 degrees Celsius. The chiller 136 will then turn off the compressor 120. Then at step 172, the chiller continues to monitor the heat exchanger temperature once every predetermined time period until the heat exchanger temperature has reached a compressor control temperature; by then, it will switch the compressor 120 on and the cycle will continue. In one implementation, the predetermined time is at least 5 seconds.

In another implementation, the compressor control temperature is at least 1 degree Celsius below the setpoint temperature In yet another embodiment, the control 148 acts as an energy managing device for use in the refrigerant based system 136 comprising the aforementioned components mentioned and performing the aforementioned steps.

The exemplary embodiments of the present invention are thus fully described. Although the description referred to particular embodiments, it will be clear to one skilled in the art that the present invention may be practiced with variation of these specific details. Hence this invention should not be construed as limited to the embodiments set forth herein.

What is claimed is:

1. A method that regulates a medium temperature of an enclosed space in a refrigerant based system, the method comprising:

measuring, by a medium temperature sensor in the refrigerant based system, the medium temperature;

checking, by a microprocessor in the refrigerant based system, if the medium temperature reaches a first predetermined value;

checking, by the microprocessor, if a compressor in the refrigerant based system operates for a predetermined period of operation time;

measuring, by a heat exchanger temperature sensor in the refrigerant based system, a heat exchanger temperature of a heat exchanger in the refrigerant based system;

checking, by the microprocessor, if the heat exchanger temperature is lower than a compressor control temperature;

determining, by the microprocessor, a minimum heat exchanger temperature by:

comparing, continuously, a newly measured heat exchanger temperature with a previously measured heat exchanger temperature;

determining the previously measured heat exchanger temperature as the minimum heat exchanger temperature if the newly measured heat exchanger temperature is higher or equal to the previously measured heat exchanger temperature;

turning off the compressor if:

the medium temperature reaches the first predetermined value;

the compressor operates for the predetermined period of operation time;

the heat exchanger temperature reaches a value below the compressor control temperature; and the minimum heat exchanger temperature is determined.

2. The method of claim 1, wherein the first predetermined value is 1° C. below a setpoint temperature.

3. The method of claim 1, wherein the predetermined period of operation time is at least 3 minutes.

4. The method of claim 1, wherein the compressor control temperature is 2° C. below a setpoint temperature.

5. The method of claim 1, wherein the medium temperature is measured by the medium temperature sensor in every five seconds.

6. The method of claim 1, further comprising:

deciding a stable setpoint temperature if a setpoint temperature is lower than a second predetermined value;

wherein the stable setpoint temperature is 23° C. and the second predetermined value is 18° C.

7. The method of claim 1, further comprising:

issuing a notification for service if a stable setpoint temperature is higher than a third predetermined value;

wherein the stable setpoint temperature is 23° C. and the third predetermined value is 10° C.

8. The method of claim 1, further comprising:

issuing a service alert if the minimum heat exchanger temperature is higher than a fourth predetermined value;

wherein the fourth predetermined value is 10° C.

9. The method of claim 1, further comprising:

restarting the compressor if the heat exchanger temperature is higher than the compressor control temperature.

10. The method of claim 1, wherein a setpoint temperature is set by a user of the refrigerant based system.

11. A refrigerant based system that regulates a medium temperature of an enclosed space, the refrigerant based system comprising:

an exterior unit that includes:

at least one compressor;

an interior unit that connects to the exterior unit by a pair of circulation pipes, and that includes;

a heat exchanger;

a heat exchanger temperature sensor that measures a heat exchanger temperature;

a medium temperature sensor that measures the medium temperature;

a microprocessor; and a computer-readable storage medium having stored therein instructions that when executed cause the microprocessor to:

measure, by the medium temperature sensor, the medium temperature;

compare continuously a newly measured heat exchanger temperature with a previously measured heat exchanger temperature;

determine the previously measured heat exchanger temperature as a minimum heat exchanger temperature if the newly measured heat exchange temperature is higher or equal to the previously measured heat exchanger temperature;

turn off the compressor if:

the medium temperature reaches a first predetermined value;

the compressor operates for a predetermined period of operation time;

the heat exchanger temperature reaches a value below a compressor control temperature; and the minimum heat exchanger temperature is determined.

12. The refrigerant based system of claim 11, wherein the computer-readable storage medium having stored therein instructions that when executed cause the microprocessor to:

check, by the microprocessor, if the medium temperature reaches a first predetermined value;

check, by the microprocessor, if the compressor operates for a predetermined period of operation time;

measure, by the heat exchanger temperature sensor, the heat exchanger temperature; and check, by the microprocessor, if the heat exchanger temperature is lower than a compressor control temperature.

13. The refrigerant based system of claim 11, wherein the medium is air.

14. The refrigerant based system of claim 11, wherein the medium is water.

15. A method that regulates an operation of a compressor in a chiller, the method comprising:

switching on the compressor after the chiller is powered up for a first delaying time period;

determining, by a microprocessor in the chiller, a minimum heat exchanger temperature by:

measuring, by a heat exchanger sensor in the chiller, a heat exchanger temperature of a heat exchanger in the chiller;

comparing, continuously, a newly measured heat exchanger temperature with a previously measured heat exchanger temperature;

determining the previously measured heat exchanger temperature as the minimum heat exchanger temperature if the newly measured heat exchanger temperature is higher or equal to the previously measured heat exchanger temperature;

turning off the compressor if the minimum heat exchanger temperature is determined; and restarting the compressor if the heat exchanger temperature reaches a compressor control temperature.

16. The method of claim 15, wherein the first delaying period is at least three minutes.

17. The method of claim 15, wherein the compressor control temperature is at least 1° C. below a setpoint temperature.

18. The method of claim 15, wherein the heat exchanger temperature is measured by the heat exchanger temperature sensor every five seconds.

* * * * *